United States Patent [19]

Paschedag et al.

[11] Patent Number: 4,493,769

[45] Date of Patent: Jan. 15, 1985

[54] TWIN PUSHER CENTRIFUGE

[75] Inventors: Hansjoachim Paschedag, Männedorf; Bruno Mülhaupt, Schlieren; Vaclav Kubr, Oberengstringen, all of Switzerland

[73] Assignee: Sulzer-Escher Wyss Ltd., Zürich, Switzerland

[21] Appl. No.: 527,564

[22] Filed: Aug. 29, 1983

[30] Foreign Application Priority Data

Sep. 6, 1982 [CH] Switzerland ..... 5277/82

[51] Int. Cl.[3] ..... B04B 3/02

[52] U.S. Cl. ..... 210/360.2; 210/374; 210/380.3; 494/58

[58] Field of Search ..... 210/360.1, 374, 375, 210/376, 369, 372, 360.2, 396, 397, 380.3, 394, 403, 377, 378, 361, 366; 209/250, 296, 385; 210/364, 365, 367, 370, 371; 494/56, 58

[56] References Cited

U.S. PATENT DOCUMENTS

| | | | |
|---|---|---|---|
| 2,350,041 | 5/1944 | Jones | 210/372 |
| 3,430,772 | 3/1969 | Ranc | 210/374 |
| 3,563,387 | 2/1971 | Nilsmar et al. | 210/376 |

FOREIGN PATENT DOCUMENTS

| | | | |
|---|---|---|---|
| 1093733 | 11/1960 | Fed. Rep. of Germany | 210/377 |
| 2631160 | 1/1978 | Fed. Rep. of Germany | 210/376 |
| 190827 | 1/1967 | U.S.S.R. | 210/360.1 |
| 599853 | 3/1978 | U.S.S.R. | 210/376 |

*Primary Examiner*—Richard V. Fisher
*Assistant Examiner*—W. Gary Jones
*Attorney, Agent, or Firm*—Werner W. Kleeman

[57] ABSTRACT

The twin pusher centrifuge contains a sieve or filter drum having discharge openings at both of its ends. At the center of the sieve or filter drum there is arranged an inclined pusher or thrust floor member. This pusher floor member rotates at a rotational speed differing from the rotational speed of the sieve or filter drum. Consequently, the pusher floor member performs a wobbling or wobble movement between two extreme positions. Due to the wobbling or wobble movement the centrifuged product is pushed towards the two ends of the sieve or filter drum. The product infeed opens within a central aperture formed in the pusher floor member, whereby the product is uniformly infed on both sides of the pusher floor member. The product infeed occurs either in a continuous or periodic fashion. In this manner an energy-saving jerk-free operation of the centrifuge is achieved using a particularly simple construction. By appropriately selecting the parameters such construction of centrifuge can be used for processing a broader spectrum of products.

18 Claims, 6 Drawing Figures

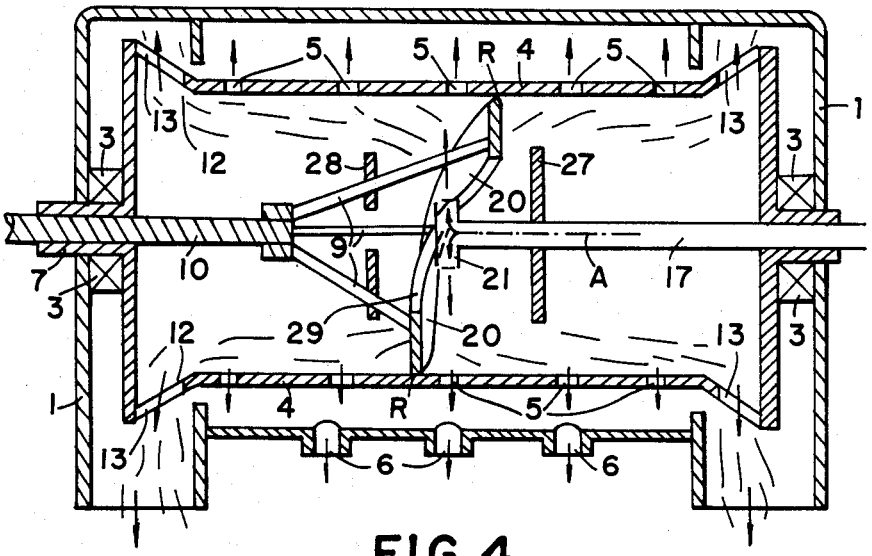
FIG. 4
FIG. 5
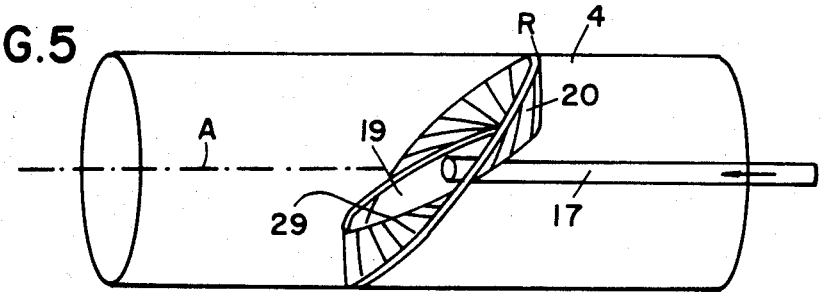
FIG. 6
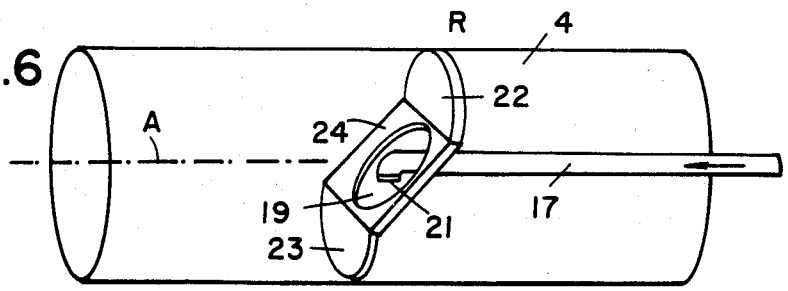

TWIN PUSHER CENTRIFUGE

CROSS-REFERENCE TO RELATED APPLICATIONS

This application is related to our commonly assigned, copending U.S. application Ser. No. 06/527,563, filed Aug. 29, 1983, entitled "TWIN PUSHER CENTRIFUGE INCLUDING ROTATABLE PUSHER", and the commonly assigned, copending U.S. application Ser. No. 06/378,833, filed May 17, 1982, entitled: "CENTRIFUGAL SEPARATOR".

BACKGROUND OF THE INVENTION

The present invention relates to a new and improved construction of a twin pusher centrifuge.

In its more specific aspects, the present invention relates to a new and improved twin pusher centrifuge comprising a sieve or filter drum which is rotatable about its lengthwise axis at a predetermined rotational speed and which contains a product infeed and product discharge outlets at both its ends. Approximately at the center of the sieve or filter drum there is arranged a pusher or thrust floor member which rotates about the sieve or filter drum axis at a rotational speed which is different from the rotational speed of the sieve or filter drum. The marginal zone of the pusher or thrust floor member which faces the inner wall of the sieve or filter drum is designed to form a line which extends at least once to-and-fro between extreme positions in the direction of the lengthwise axis of the sieve or filter drum and serves to push or displace the product along the inner wall of the sieve or filter drum.

In pusher centrifuges as known, for example, from U.S. Pat. No. 2,232,770, granted Feb. 25, 1941 or U.S. Pat. No. 4,073,731, granted Feb. 14, 1978, a planar pusher or thrust floor member is arranged normally relative to the lengthwise axis of the sieve or filter drum and is periodically reciprocated or moved to-and-fro in axial direction. The product is supplied through a product infeed located close to the pusher or thrust floor member and is periodically pushed or displaced in the direction towards the product discharge by means of the oscillating to-and-fro reciprocation movement of the pusher or thrust floor member. The centrifuge thus can be continuously operated. However, a complicated and expensive mechanical or hydraulic drive system is required for periodically reciprocating the pusher or floor thrust member, and considerable energy is consumed for moving the masses. The mass forces occurring in conjunction therewith cause an unsteady operation of the centrifuge and the exertion of high loads upon the bearings. Furthermore, the movement of the pusher or thrust floor member in only one direction is used for discharging the product.

In another construction of pusher centrifuge as known, for example, from U.S. Pat. No. 2,350,041, granted May 30, 1944, the aforementioned disadvantages can be partially eliminated by replacing the reciprocating pusher or thrust floor member with a pusher floor member which is arranged at an inclination with respect to the sieve or filter drum axis and which rotates at a different rotational speed. In this case the pusher or thrust floor member performs a wobbling or wobble movement relative to the sieve or filter drum. Due to this wobble movement the product is further displaced or transported at the individual locations at the sieve or filter drum in a similar manner as in a pusher centrifuge containing a reciprocating pusher or thrust floor member. Since the transport of the product occurs in a timewise-shifted manner around the circumference of the sieve or filter drum and since there are only provided rotational movements without continuous acceleration and deceleration of masses, such a centrifuge containing an inclined pusher or thrust floor member has a lower energy consumption and a more steady or quieter operation.

In modifications of the last-mentioned pusher centrifuge as described, for example, in German Pat. No. 1,065,333, granted Sept. 10, 1959, the pusher or thrust floor member is designed, for instance, with a corrugated or undulated marginal zone such as to extend to-and-fro more than once in axial direction. The displacement or stroke frequency is thus multiplied in comparison to a single floor member arranged at an inclination which has a displacement or stroke frequency corresponding to the difference in rotational speeds. Furthermore, there is described a twin pusher centrifuge in which the pusher floor member is arranged at the center of a sieve or filter drum provided with discharge openings at both its ends. This pusher or thrust floor member either is arranged at an inclination or is provided with a marginal zone extending to-and-fro. By using such a design there is utilized the movement of the pusher or thrust floor member in both directions. Thus, the output of the centrifuge is nearly doubled and a relatively steady or quiet run is obtained due to the symmetrical structure. However, it is a disadvantage of this construction that a product infeed has to be provided on each of the two sides of the pusher or thrust floor member which is arranged at the center of the sieve or filter drum. The product infeed into the centrifuge thus occurs simultaneously on two opposite sides, however, using separate product infeeds which makes the construction complicated and expensive. Furthermore it cannot be ensured that the product infeed on the two sides always remains exactly the same, which causes disturbing asymmetries and requires the use of an expensive automatic control for the product infeed.

SUMMARY OF THE INVENTION

Therefore, with the foregoing in mind it is a primary object of the present invention to provide a new and improved twin pusher centrifuge which is not associated with the aforementioned limitations and drawbacks of the prior art constructions.

Another and more specific object of the present invention aims at providing a new and improved twin pusher centrifuge which is of a more simple and less expensive construction.

Still a further significant object of the present invention is directed to a new and improved twin pusher centrifuge of increased output and yet requiring less energy consumption.

Another important object of the present invention is directed to a new and improved construction of a twin pusher centrifuge which has a more steady run or operation than the prior art centrifuge constructions.

Yet another important object of the present invention is directed to a new and improved construction of a twin pusher centrifuge which contains a uniformly operating product infeed.

Now in order to implement these and still further objects of the invention, which will become more readily apparent as the description proceeds, the twin pusher centrifuge of the present development is manifested by the features that, the pusher or thrust floor member is provided with a central opening which at most is interrupted by supporting webs, and through such central infeed the product infeed extends so as to approximately open at the center of the pusher floor member for infeeding the product on both sides of the pusher floor member.

BRIEF DESCRIPTION OF THE DRAWINGS

The invention will be better understood and objects other than those set forth above, will become apparent when consideration is given to the following detailed description thereof. Such description makes reference to the annexed drawings wherein there have been generally used throughout the same reference characters to denote the same or analogous components and wherein:

FIG. 4 is a sectional view of a second embodiment of twin pusher centrifuge according to the invention;

FIG. 5 is a perspective view of one possible construction of the pusher floor member used in the twin pusher centrifuge shown in FIG. 4; and FIG. 6 is a perspective view of a further design of the pusher floor member used in the twin pusher centrifuge shown in FIG. 4.

DETAILED DESCRIPTION OF THE PREFERRED EMBODIMENTS

Figure 1:
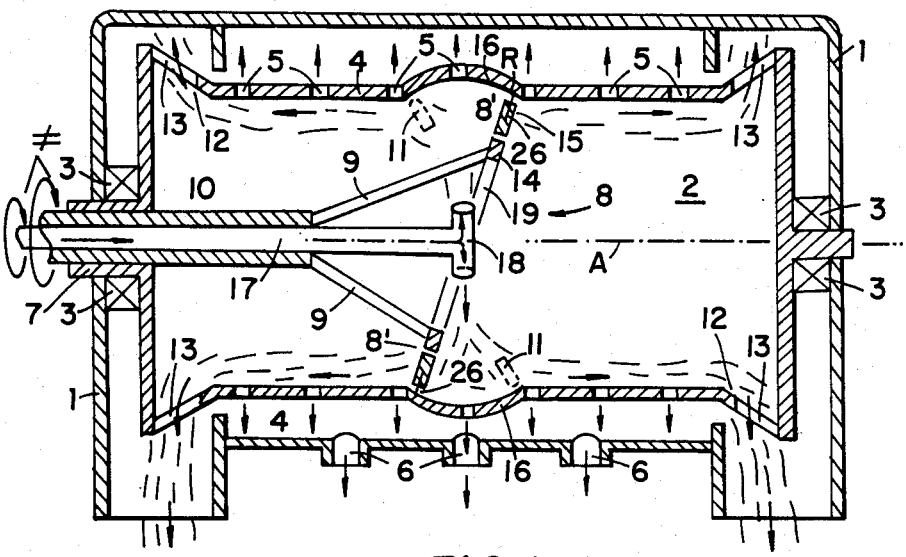
FIG. 1 is a sectional view of a first embodiment of a twin pusher centrifuge according to the invention.

Describing now the drawings, it is to be understood that only enough of the construction of the exemplary embodiment of twin pusher centrifuges has been shown as needed for those skilled in the art to readily understand the underlying principles and concepts of the present development, while simplifying the showing of the drawings. Turning attention now specifically to FIG. 1, there has been schematically illustrated therein in section a first embodiment of a twin pusher centrifuge according to the invention. In this first exemplary embodiment shown in FIG. 1 there is provided a centrifuge housing 1 and a rotatable sieve or filter drum member or drum 2 arranged therein which is journaled relative to the centrifuge housing 1 by means of bearings 3. The sieve or filter drum 2 is provided with a largely cylindrically designed shell or jacket 4 which contains a plurality of openings or orifices 5 in the wall of such shell 4 for the passage of centrifuged liquid which is drained from the centrifuge housing 1 of the twin pusher centrifuge through further openings or ports 6. The sieve or filter drum 2 is driven at a predetermined rotational speed via a hollow shaft 7 driven by any suitable drive motor or drive, and is thus placed into rotation.

Approximately at the center of the sieve or filter drum 2 there is provided a pusher or thrust floor member 8 which is designed as a substantially circular ring or annular plate which is inclined relative to the lengthwise axis A of the sieve or filter drum 2. This ring or plate may form a solid ring or plate which is mounted at a predetermined angle of inclination at a further hollow shaft 10 by means of holding or supporting webs 9. When the further hollow shaft 10 is driven at a rotational speed which is different from the rotational speed of the hollow shaft 7, then the pusher or floor member 8 performs a wobble or swashplate-like movement relative to the sieve or filter drum 2 between one extreme position 8' and another opposite extreme position 11 which are indicated in FIG. 1. During each stroke or displacement period the product which has been fed-in and which has already been partially dewatered is displaced in the direction towards the outlets or discharge openings 13 which are provided at two conically designed ends or terminal regions 12 of the sieve or filter drum 2. During this operation the stroke or displacement frequency corresponds to the difference between the rotational speeds of the sieve or filter drum 2 and the pusher floor member 8. The stroke or displacement frequency and the inclination of the pusher or thrust floor member 8 which determines such stroke or displacement are conveniently adapted to the requirements of the product to be dewatered or otherwise processed. Depending upon the properties of the product to be treated, the stroke or displacement frequency therefore can be selected from the range of only a small number of oscillations per second which corresponds to a rotation of the pusher floor member 8 at a speed close to the rotational speed of the sieve or filter drum 2, to the rotational speed of the sieve or filter drum 2 with the pusher or thrust floor member 8 at a standstill relative to the sieve or filter drum 2. Moreover, the inclination of the pusher or thrust floor member 8 may assume any angle in the range of a few degrees to approximately 30°.

As illustrated in the exemplary embodiment under discussion, the pusher or thrust floor member 8 may be composed of two concentric rings or annular plates 14 and 15. The inner ring or plate 14 is mounted to the supporting webs 9 or the like while the outer ring or plate 15, defining an outer edge portion, can freely rotate about the inner ring or plate 14, and thus, is entrained by the rotating sieve or filter drum 2. The product to be dewatered is thus treated in a particularly productive manner. To maintain the gap which is formed between the outer margin or edge of the outer ring or plate 15 and the inner wall of the sieve or filter drum 2 during the wobbling or wobble movement of the pusher or thrust floor member 8 as small as possible, it is advantageous to design the central portion or region 16 of the sieve or filter drum 2 so as to possess a substantially spherical or outwardly curved shape. In case that, however, there is used a non-subdivided pusher or thrust floor member 8 which is not entrained by the sieve or filter drum 2, then the sieve or filter drum 2 may be constructed to possess a continuous cylindrical design. It is, then, advantageous if the pusher or thrust floor member 8 is of substantially elliptical shape. For improved sealing purposes a radially movable ring 26 or equivalent structure may be inserted into the outer edge portion of the pusher or thrust floor member 8. During operation this ring 26 is pressed against the inner wall of the sieve or filter drum 2 by the centrifugal force or by a spring or resilient force.

The infeed of the product to be centrifuged is effected by a product infeed or product supply means comprising a product infeed pipe 17 which is concentrically provided within the hollow shafts 10 and 7 and which approximately opens at the center of the pusher or thrust floor member 8. For this purpose the pusher or thrust floor member 8 has a central opening aperture 19 into which extend the two outlets or discharge openings 18 of the product infeed pipe 17 and these product outlets 18 co-rotate with the hollow shaft 10. The product is thus simultaneously infed on both sides of the pusher or thrust floor member 8 and uniformly supplied to both halves of the sieve or filter drum 2. Due to the wobbling or wobble movement of the pusher or thrust floor member 8 further product is supplied immediately after the product has been pushed farther outwardly by the pusher or thrust floor member 8. Since a certain delay time or dead-time for dewatering is available until the next-following product supply, even dilute suspensions can be effectively treated without the danger of flooding the centrifuge. For precise central positioning the outlet or outlets 18 may be positionally adjustable in axial direction.

Figure 2:
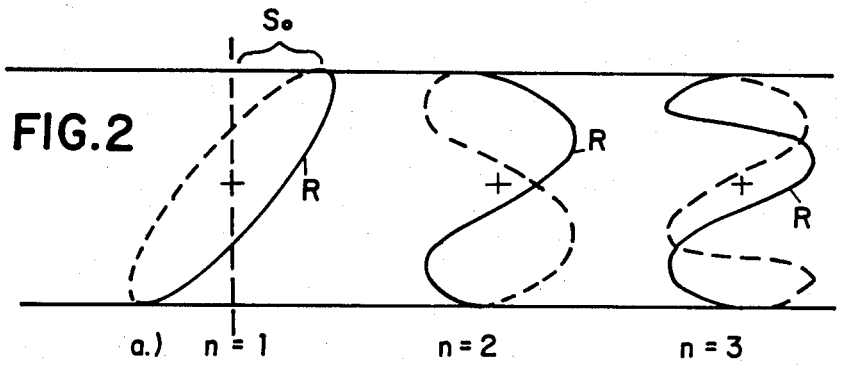
FIGS. 2 and 3 illustrate possible designs of the marginal zone or outer edge of the pusher floor member in the twin pusher centrifuge shown in FIG. 1.

In FIG. 2 different possibilities for the design of the marginal zone or outer edge portion R of the pusher or thrust floor member 8 are illustrated in a schematically simplified manner. In the twin pusher centrifuge as described hereinbefore the marginal zone or outer edge portion R of the pusher or thrust floor member 8 is designed as a circle or an ellipse. In this case the course of the marginal zone or outer edge portion R of the pusher or thrust floor member 8 across the inner wall of the shell or jacket 4 of the sieve or filter drum 2 in the direction of the lengthwise axis A thereof can be conceived as a closed sine or sinusoidal cycle in axial direction, the amplitude $S_o$ of which represents the amplitude of the gyrating movement of the pusher or thrust floor member 8 or half of its stroke. It is thus possible that the marginal zone or outer edge portion R of a pusher or thrust floor member 8 which is designed as an inclined ellipse corresponds to a single sine or sinusoidal cycle for each revolution along the shell 4 of the sieve or filter drum 2 in respect of the reciprocation of the marginal zone or outer edge portion R in axial direction. However, it is also possible to design the marginal zone or outer edge portion R of the pusher or thrust floor member 8 in such a way as to form a number of sine or sinusoidal cycles which extend to-and-fro in axial direction in correspondence to the equation $$S = S_o \cdot \sin(n \cdot \alpha)$$

wherein n is an integer. In FIG. 2 the cases with n=1, 2 and 3 are illustrated. In the second case the marginal zone or outer edge portion R is similar to an ellipse having a bent major axis, while at greater period numbers n the pusher or thrust floor member 8 more closely resembles a disk or plate provided with a corrugated or undulated rim.

Figure 3:
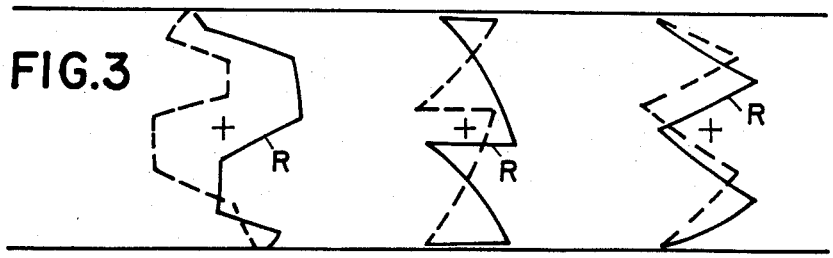

When designed in a sine-shape the marginal zone or outer edge portion R of the pusher or thrust floor member 8 affords the advantage of providing a specifically gentle, transition-free and jerk-free operation. However, as shown in FIG. 3, the marginal zone or outer edge portion R can also be constructed to extend to-and-fro in axial direction in different ways as, for example, along a substantially trapezoidal line as in FIG. 3(*b*), in the shape of a saw-tooth as in FIG. 3(*c*), or in a roof-edge or gable shape as in FIG. 3(*d*). Such designs may be advantageous when processing difficult products which require jerk-like dispersion or loosening during further transport thereof.

In the first embodiment as illustrated in FIG. 1 the pusher or thrust floor member 8 has been designed as a substantially planar circular or elliptical ring or plate. The central opening or aperture 19 therein is similarly shaped to the marginal zone or outer edge portion R of the pusher or thrust floor member 8 and is arranged concentrically thereto. The outer edge portion R faces the inner wall of the sieve drum 2 and circumferentially extends closely adjacent thereto and along a predetermined portion of the axial length thereof between the aforementioned two extreme positions 8' and 11 as clearly shown in FIG. 1. At the start of the pushing operation, when the ring or plate which constitutes the pusher or thrust floor member 8 moves relative to the sieve or filter drum 2, such ring or plate forms an acute angle with the generatrix of the shell 4 or, respectively, the lengthwise axis A of the sieve or filter drum 2 and into which angle the product can be squeezed. This can be of a disadvantage at large angles of inclination of the pusher or floor thrust member 8 and during the processing of certain types of products.

In the second embodiment of twin pusher centrifuge according to the invention which is illustrated in FIG. 4, an acute angle is avoided by providing a specific design of the pusher or thrust floor member. In this embodiment the pusher or thrust floor member is structured as a pusher ring or plate 20 defining an outer edge portion, the surface of which encompasses the radial direction over its entire circumference. In this way there results a doubly-curved and twisted surface of the pusher ring or plate 20 which is shown in section in FIG. 4 and in perspective in FIG. 5. Again, a central opening or aperture 19 is provided into which opens the product infeed pipe 17 of a product infeed or product supply means. By providing such a construction of the pusher or thrust floor member the pushing or outer edge portion thereof always extends normally or perpendicularly relative to the shell or jacket 4 of the sieve or filter drum 2.

Furthermore, this second embodiment of twin pusher centrifuge as shown in FIG. 4 also differs from the first embodiment shown in FIG. 1 by the arrangement of a stationary, i.e. non-rotating product infeed pipe 17 at the non-driven side or half of the sieve or filter drum. This can be structurally advantageous because no hollow shaft is required. A further advantage is here achieved by virtue of the annularly designed outlet or discharge 21 of the product infeed pipe 17 which simultaneously extends in all radial directions. In such an arrangement the product flow is periodically interrupted during the infeed operation by the internal or inner edge 29 of the pusher ring or plate 20 and to prevent the product from spraying to both sides of the outlet 21 protective surfaces or facilities, such as plates or baffles 27 and 28 are provided to both sides of such outlet 21. The protective surface 27 is mounted to the stationary product infeed pipe 17 and the other protective surface 28 is mounted to the rotating supporting webs 9. However, instead of this arrangement there can be provided only one outlet directed in only one direction or two or more outlets directed towards separate directions.

In FIG. 6 there is illustrated a modification of the pusher ring 20 in which the marginal zone or outer edge portion of the pusher or thrust floor member at all locations still extends normally to the sieve or filter drum 2, but in which there is avoided a doubly-curved surface which is difficult to manufacture. There will thus result not a continuous sinusoidal line described by the rotating outer edge portion of the pusher or thrust floor member along the inner wall of the sieve drum, but a trapezoidal line of the type depicted in FIG. 3(*b*) of the drawings. In such a design the pusher or thrust floor member is constituted by substantially planar members 22, 23, 24 which can be readily manufactured.

All the embodiments and modifications described hereinbefore have the advantage that no reciprocation of masses is required, only a rotary movement. No energy is therefore required for accelerating and decelerating the masses and the operation is essentially jerk-free to a large extent. Also, the product is continuously infed so that no return pressure shocks occur. The product may be continuously distributed, but also can be discontinuously and periodically distributed at individual locations of the shell or jacket 4 of the sieve or filter drum 2. In this way products which are difficult to handle also can be centrifuged without the danger of flooding of the centrifuge. The aforementioned advantages are achieved by an extremely simple and not too complicated construction of the inventive twin pusher centrifuge.

While there are shown and described present preferred embodiments of the invention, it is to be distinctly understood that the invention is not limited thereto, but may be otherwise variously embodied and practiced within the scope of the following claims. Accordingly,

What we claim is:

1. A twin pusher centrifuge comprising:

a centrifuge housing;

a sieve drum defining a lengthwise axis and arranged in said housing;

said sieve drum having two oppositely located ends and an inner wall;

means for rotating said sieve drum about said lengthwise axis thereof at a predetermined rotational speed;

said sieve drum being provided with product discharge outlets at said two oppositely located ends;

at least one product infeed;

a pusher floor member located approximately at a central region of said sieve drum;

means for rotating said pusher floor member about said lengthwise axis at a rotational speed which is different from said predetermined rotational speed of said sieve drum;

said pusher floor member possessing an outer edge portion facing said inner wall of said sieve drum;

said outer edge portion circumferentially extending adjacent said inner wall of said sieve drum and defining a plane which is inclined relative to the lengthwise axis of the sieve drum and further defining at least two axial extreme positions in order to push a product fed-in through said at least one product infeed along said inner wall of said sieve drum to said product discharge outlets at said two oppositely located ends of said sieve drum, when said pusher floor member and said sieve drum are rotated relative to each other;

supporting webs for supporting said pusher floor member;

said pusher floor member containing a substantially central opening which at most is interrupted by said supporting webs; and said at least one product infeed extending into said substantially central opening and opening approximately at said substantially central opening in order to substantially uniformly supply said product towards both sides of said outer edge portion of said pusher floor member.

2. The twin pusher centrifuge as defined in claim 1, wherein:

said sieve drum is predominantly structured as a cylinder.

3. The twin pusher centrifuge as defined in claim 2, wherein:

said outer edge portion of said pusher floor member facing said inner wall of said sieve drum is substantially structured as an ellipse.

4. The twin pusher centrifuge as defined in claim 3, wherein:

said outer edge portion of said pusher floor member comprises a substantially elliptical ring.

5. The twin pusher centrifuge as defined in claim 2, wherein:

said pusher floor member comprises a pusher ring defining said outer edge portion which extends substantially normally relative to said cylindrical sieve drum.

6. The twin pusher centrifuge as defined in claim 2, wherein:

said outer edge portion of said pusher floor member which faces said inner wall of said sieve drum possesses the shape of a continuous sinusoidal line encompassing a number of complete cycles and extending along said inner wall of said sieve drum.

7. The twin pusher centrifuge as defined in claim 2, wherein:

said outer edge portion of said pusher floor member which faces said inner wall of said sieve drum possesses a continuous substantially trapezoidal line encompassing a number of trapezoidal cycles extending along said inner wall of said sieve drum.

8. The twin pusher centrifuge as defined in claim 2, wherein:

said outer edge portion of said pusher floor member which faces said inner wall of said sieve drum possesses a closed substantially saw-tooth line extending along said inner wall of said sieve drum.

9. The twin pusher centrifuge as defined in claim 2, wherein:

said outer edge portion of said pusher floor member which faces said inner wall of said sieve drum possesses a closed substantially zig-zag line extending along said inner wall of said sieve drum.

10. The twin pusher centrifuge as defined in claim 7, wherein:

said pusher floor member is composed of a number of substantially planar outer edge portions interconnected by a planar central portion.

11. The twin pusher centrifuge as defined in claim 1, wherein:

said outer edge portion of said pusher floor member facing said inner wall of said sieve drum is structured to possess a substantially circular configuration.

12. The twin pusher centrifuge as defined in claim 11, wherein:

said sieve drum has a section located within the range of movement of said substantially circular-shaped outer edge portion of said pusher floor member; and said section is structured to possess an outwardly curved shape.

13. The twin pusher centrifuge as defined in claim 11, wherein:

said pusher floor member comprises a substantially annular-shaped outer ring and an inner ring; and said outer ring defining said outer edge portion and being movable about said inner ring and being entrainable by said sieve drum during rotation thereof.

14. The twin pusher centrifuge as defined in claim 1, further including:

a radially movable sealing ring provided for said outer edge portion of said pusher floor member.

15. The twin pusher centrifuge as defined in claim 1, wherein:

said at least one product infeed contains outlet means structured to be simultaneously directed in all radial directions towards said inner wall of said sieve drum.

16. The twin pusher centrifuge as defined in claim 1, wherein:

said at least one product infeed comprises outlet means structured to be simultaneously directed in two radial directions towards said inner wall of said sieve drum.

17. The twin pusher centrifuge as defined in claim 16, wherein:

said outlet means is structured to be simultaneously directed in two opposite radial directions towards said inner wall of said sieve drum.

18. The pusher centrifuge as defined in claim 1, wherein:

said at least one product infeed comprises outlet means which is displaceable in the direction of said lengthwise axis of said sieve drum.

* * * * *